US005931405A

United States Patent [19]

Paucher

[11] Patent Number: 5,931,405

[45] Date of Patent: Aug. 3, 1999

[54] METHOD FOR ACHIEVING WINDINGS IN RADIAL LAYERS

[76] Inventor: Aimé Paucher, 86, Chemindu Cellier, Vif, France, 38450

[21] Appl. No.: 08/944,129

[22] Filed: Oct. 6, 1997

[51] Int. Cl.[6] ..... H01F 41/06

[52] U.S. Cl. ..... 242/447.3; 242/445.1; 140/92.2

[58] Field of Search ..... 242/362, 443, 242/445, 445.1, 447.3, 447, 910; 140/92.2; 29/605

[56] References Cited

U.S. PATENT DOCUMENTS 1,813,994 7/1931 George ..... 242/443
3,216,671 11/1965 Rahn ..... 242/910
3,640,112 2/1972 Meyfarth et al. ..... 242/362
3,750,719 8/1973 Goldman et al. ..... 242/443
5,167,063 12/1992 Hulsink ..... 29/605

*Primary Examiner*—Katherine Matecki
*Attorney, Agent, or Firm*—Arthur L. Plevy

[57] ABSTRACT

The present invention relates to a method for achieving windings in radial layers alternately wound from the outside to the inside and from the inside to the outside. To wind a layer from the outside to the inside, the method includes the steps of forming around a core the layer with an internal diameter greater than the core diameter, and exerting a traction on the internal winding to tighten the layer on the core.

8 Claims, 2 Drawing Sheets

METHOD FOR ACHIEVING WINDINGS IN RADIAL LAYERS

BACKGROUND OF THE INVENTION

1. Field of the Invention

The present invention relates to the realization of an electric coil having radial winding layers, alternately wound from the inside to the outside and from the outside to the inside.

2. Discussion of the Related Art

When such coils are used in high voltage applications, for example in transformers, they have the advantage of requiring no insulator between winding layers. This result is obtained due to the fact that two adjacent windings of two successive layers are only separated by a small number of turns, so that they are submitted to a relatively low potential difference which does not require the interposition of an insulator between the two layers.

SUMMARY OF THE INVENTION

An object of the present invention is to provide a method for winding such radial layer coils, which is particularly simple to implement.

Another object of the present invention is to provide such a method which enables, by means of a single device, to make coils of variable internal and external diameters.

These objects are achieved according to the present invention by means of a method for achieving windings in radial layers alternately wound from the outside to the inside and from the inside to the outside. To wind a layer from the outside to the inside, the method includes the steps of forming around a core the layer with an internal diameter greater than the core diameter, and exerting a traction on the internal winding to tighten the layer on the core.

According to an embodiment of the present invention, the layer is formed by exerting an axial pressure on the windings while they are wound.

According to an embodiment of the present invention, the method further includes the steps of winding directly around the core the next layer from the inside to the outside while exerting a pressure on the exposed surface of this layer; axially shifting the layers by the thickness of two layers; maintaining at the periphery the last layer by providing a supporting plane to a new layer; and making the new layer wound from the outside to the inside.

The present invention also provides an apparatus for carrying out the above-mentioned method, including a radial ring surrounding the core and defining therewith a winding space for a current layer; radial rollers extending to the core and urged towards the upper surface of the ring; radial shims movable between a position in contact with the core and a retracted position, these shims being shifted down with respect to the upper surface of the ring by a distance comprised between one layer thickness and two layer thicknesses; and means for lifting the ring with respect to the core by two layer thicknesses.

According to an embodiment of the present invention, the ring includes retractable platforms associated with the rollers to enable the rollers to be lowered.

According to an embodiment of the present invention, the apparatus includes a wire supply for supplying the currently wound windings at the level of one of the rollers, the wire supply being adapted to selectively exert a traction or an axial pressure on the wire.

According to an embodiment of the present invention, the rollers are cone-shaped, their greater diameter being on the core side.

According to an embodiment of the present invention, the rollers are fixed and the ring, shims and core all rotate.

The foregoing objects, features and advantages of the present invention, will be discussed in detail in the following non-limiting description of specific embodiments made in connection with the accompanying drawings.

DETAILED DESCRIPTION

An essential aspect of the winding method according to the present invention lies in the implementation of layers wound from the outside to the inside. To implement such a layer according to the present invention, it is first wound from the outside to the inside from an external diameter greater than the external diameter of the future coil. This is advantageously done by exerting an axial pressure on the currently wound winding, so that the entire layer tends to enlarge. Once the number of windings of the layer is reached, the internal diameter of the layer is inevitably greater than the diameter of the core of the future coil. Then, a traction is exerted on the last winding, i.e. on the inner winding, to tighten the entire layer on the core, which may be of any cross-section and diameter.

Figure 1:
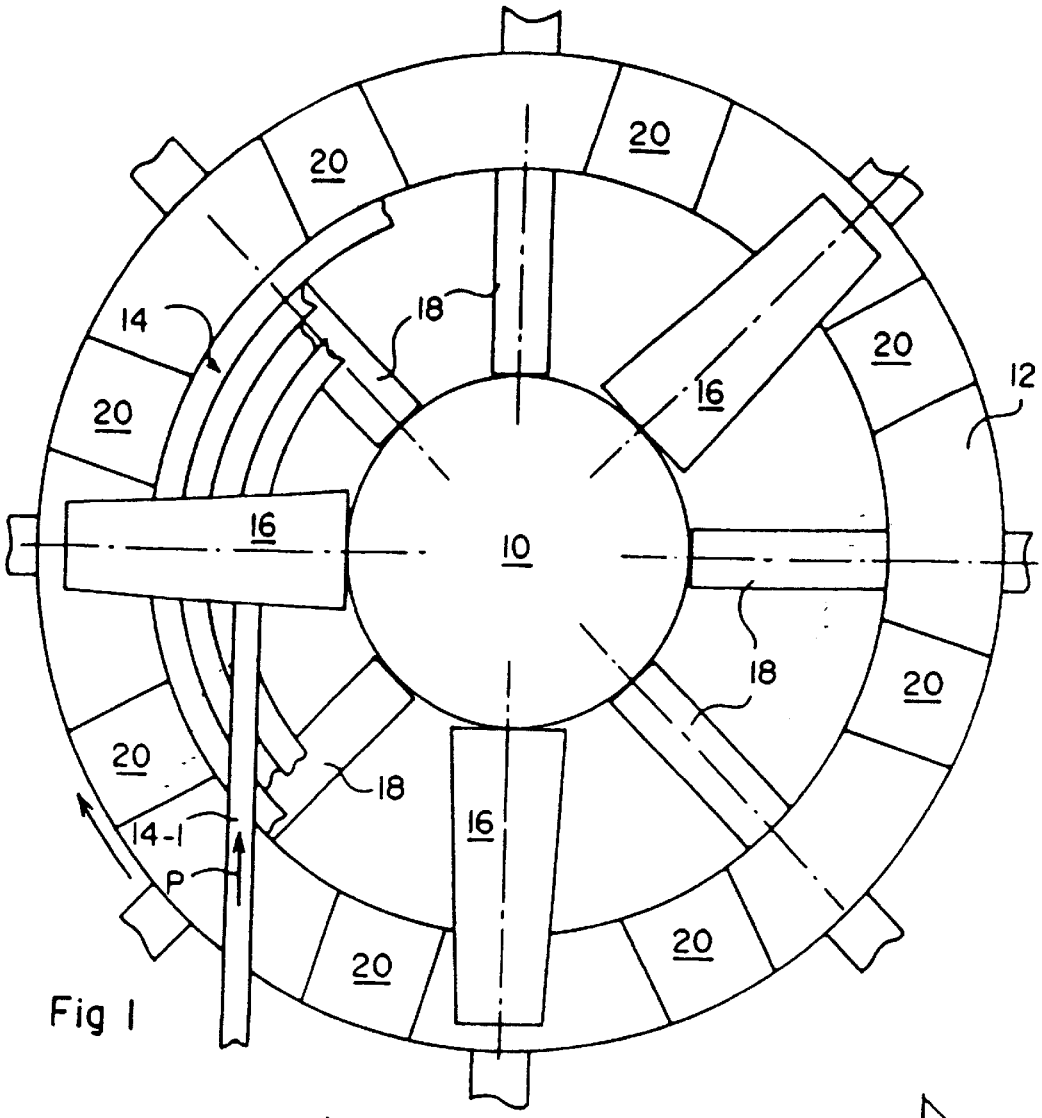
FIG. 1 shows a top view of an embodiment of a winding apparatus for carrying out the winding method according to the present invention.
Figure 2A:
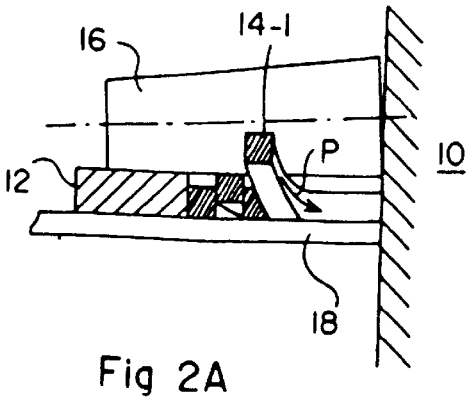
FIGS. 2A to 2F show a partial cross-sectional side view of the apparatus of FIG. 1, at successive steps of the winding method according to the present invention.

FIGS. 1 and 2A show a top view and a partial side cross-sectional view of an embodiment of a winding apparatus for carrying out the method according to the present invention. The core 10 of the future coil is placed substantially at the center of a radial ring 12. The space between core 10 and ring 12 is meant to receive a currently wound layer 14. The internal diameter of the ring thus determines the maximum external diameter of the coil.

The upper surface of layer 14 is maintained by radial rollers 16 (only three of which are shown) which are urged towards the upper surface of ring 12 and engage core 10. These rollers 16 slide axially to allow the diameter of core 10 to be modified. The winding wire 14-1 arrives tangentially from under one of rollers 16. To facilitate the introduction of wire 14-1, an area without rollers may be provided in front of the roller which receives the wire.

The lower surface of layer 14 is maintained by radial shims 18 regularly distributed around core 10 under ring 12. Each of these shims 18 is movable between a position of engagement with core 10 and a retracted position where the inner end of the shim is substantially at the level of the internal diameter of ring 12. The travel of these shims 18 and of rollers 16 determines the minimum diameter of core 10.

Ring 12, core 10, and shims 18 all rotate around the core axis while rollers 16 are fixed. As shown, rollers 16 are preferably cone-shaped, the greater diameter being on the side of core 10. Rollers 16 are then tilted to provide a horizontal support plane to wound layer 14. As a result, the contact area between each roller 16 and core 10 is reduced to a point, which reduces friction.

Ring 12 includes platforms 20 which can be brought into correspondence with rollers 16 by a rotation of ring 12.

These platforms 20 are retractable downwards to enable rollers 16 to lower down and join the plane of shims 18.

As shown as an example, wire 14-1 is rectangular or square. Such a choice will be preferred, since it facilitates the adjusting of the apparatus to the wire cross-section. Indeed, the distance separating rollers 16 from shims 18 may then be freely adjusted between once and twice the height of the wire. Thus, with a single setting, wires of heights varying by a factor two can be wound.

If the wire is of circular section, the height of shims 18 must be adjusted so that the distance separating the shims from rollers 16 is substantially equal to the wire diameter, this to avoid that windings of a same layer overlap. To facilitate the winding of a circular cross-section wire, it will be preferred to laminate the wire so that it has flats parallel to the winding axis, which will prevent overlapping.

FIGS. 1 and 2A illustrate a first step in the winding of a first layer from the outside to the inside. Rollers 16 are in contact with the upper surface of ring 12 and shims 18 are supported by core 10. Ring 12 (as well as shims 18 and core 10) is rotated clockwise, for example. A wire supply, not shown, supplies wire 14-1 with a given axial pressure P in the rotation direction of ring 12. This pressure P is chosen so that the currently wound windings tend to move away from core 10. Thus, the first winding tends to press against the internal diameter of ring 12 and each following winding tends, as shown, to press against the inside of the preceding winding.

When the desired number of windings is reached, the layer which has just been wound normally has an internal diameter greater than the core diameter.

Figure 2B:
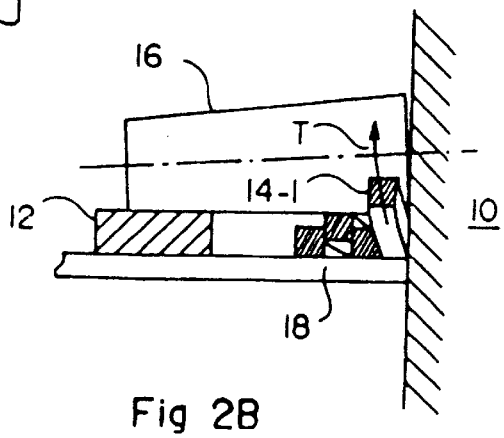

The next step, illustrated in FIG. 2B, consists of exerting a traction T on wire 14-1 until the newly wound layer tightens on core 10. This traction T is preferably exerted by stopping ring 12 and by operating the wire supply in the reverse direction. According to an alternative, traction T could be obtained by slowing down the wire supply while ring 12 keeps on turning.

As shown in FIGS. 2A and 2B, if the spacing between rollers 16 and shims 18 is greater than the height of the wire, the obtained windings are generally not in the same plane. This is not disturbing, as will be seen hereafter.

Figure 2C:
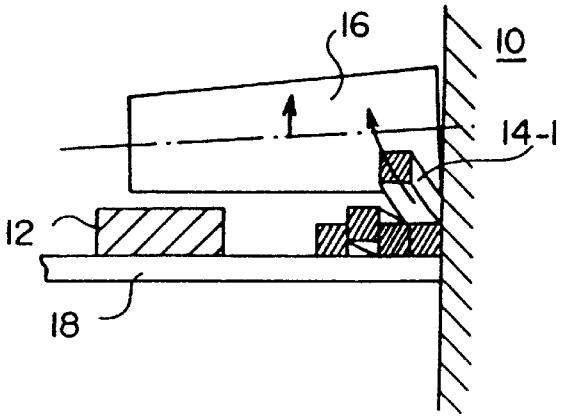

In FIG. 2C, the layer newly wound from the outside to the inside has just been tightened around core 10 and ring 12 rotates clockwise. The currently wound winding 14-1, for lack of room, goes over the last, internal winding of the newly wound layer and lifts up rollers 16. Indeed, these rollers 16 slide vertically and are urged downwards resiliently or by mere gravity. Thus, the currently wound winding and the winding located immediately thereunder are forced towards shims 18 under the pressure exerted by rollers 16. The successive windings will wind from the inside to the outside while they align the windings of the preceding layer.

Figure 2D:
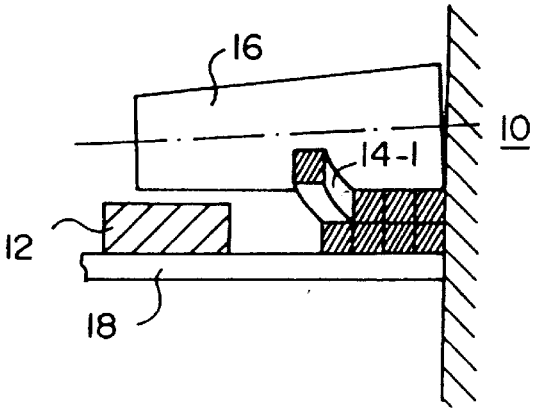

In FIG. 2D, the desired number of windings for the second layer has been reached. As shown, the two layers just wound are perfectly flat.

Figure 2E:
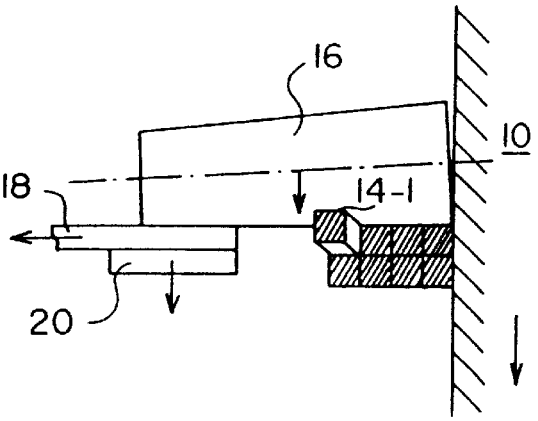

In FIG. 2E, ring 12 rotates, if necessary, by a fraction of a turn to bring platforms 20 in correspondence with rollers 16. Then, platforms 20 are lowered while shims 18 are retracted. In practice, the layers just wound are so tight on core 10 that they cannot slide down under the effort of rollers 16. Further, this sliding is not desirable since it might damage the insulation of the internal windings. Instead, ring 12 is shifted with respect to core 10 by the height of two layers, as illustrated. For this purpose, ring 12 is lifted, for instance, by a jack, the position of which may be set by digital control. According to an alternative, core 10 could be lowered, which would however have the disadvantage of doubling the bulk in height of the apparatus, due to the fact that core 10 would have to move to both sides of ring 12.

Figure 2F:
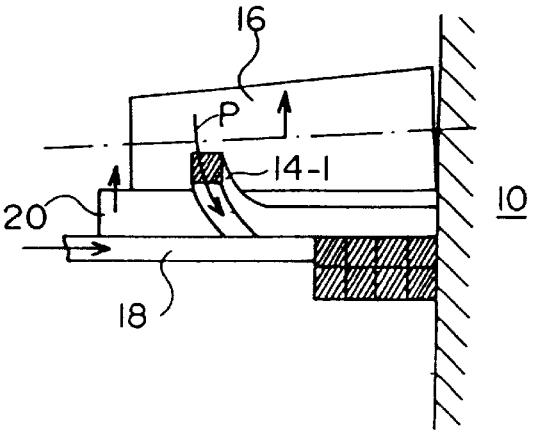

In FIG. 2F, shims 18 are slid towards core 10 and platforms 20 are then raised to their initial position. The internal ends of shims 18 abut against the external winding of the last wound layer and maintain this layer which would otherwise tend to unwind.

The device is then ready to resume the step illustrated in FIG. 2A to wind a new layer from the outside to the inside.

Each layer may be realized with a different diameter. This possibility has the advantage of allowing the creation of intermediary output terminals for which the total number of windings is not a multiple of the nominal number of windings of the layers.

To enable the realization of a layer of smaller diameter than that of the preceding layer at the step of FIG. 2D, the thickness of shims 18 is chosen smaller than the thickness of the layers. Then, the shims can always reach the external diameter of this layer at the step of FIG. 2F.

According to an advantageous alternative (not shown) of the apparatus, ring 12 is continuous, that is, without retractable shims 20. Then, to pass from the step of FIG. 2D to that of FIG. 2E, several pushers are provided which press on the new wound layer in the space defined between rollers 16, core 10, and the internal diameter of ring 12. These pushers move down at the same time as the rollers and keep on going down when rollers 16 abut against the upper surface of ring 12, to bring the last wound layer to the level of radial shims 18 in FIG. 2E.

The shifting movements of the several elements of the apparatus, except for core 10, are ensured by air jacks, for example. The rotation may be ensured by a d.c. motor.

In the foregoing description, it has been assumed as an example that core 10 has a circular cross-section. It can of course have any cross-section.

The present invention is likely to have various alterations, modifications, and improvements which will readily occur to those skilled in the art. For example, several parallel wires may be wound at the same time.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A method for forming windings in radial layers alternately wound from an outside to an inside and from the inside to the outside, comprising the steps of:

for winding a layer from the outside to the inside: forming around a core an outside-in layer with an internal diameter greater than a diameter of said core; and, exerting a traction on an inner-most winding of said outside-in layer to tighten the outside-in layer on the core; and, for winding a layer from the inside to the outside: winding directly around the core an inside-out layer from the inside to the outside.

2. The winding method of claim 1, further comprising the step of exerting an axial pressure on windings of said outside-in layer while they are wound.

3. The winding method of claim 1, further comprising the steps of: exerting a pressure on an exposed surface of the inside-out layer;

axially shifting said outside-in and inside-out layers by the thickness of two layers;

maintaining at a periphery the inside-out layer by providing a supporting plane; and forming around said core another outside-in layer with an internal diameter greater than said diameter of said core.

4. An apparatus for constructing windings in radial layers alternately wound from an outside to an inside and from the inside to the outside comprising:

a radial ring surrounding a core and defining therewith a winding space for a current layer;

radial rollers extending to the core and urged towards the upper surface of the ring;

radial shims movable between a position in contact with the core and a retracted position, and means for shifting the shims down with respect to the upper surface of the ring by a distance between one layer thickness and two layer thicknesses; and means for raising the ring with respect to the core by two layer thicknesses.

5. The apparatus claim 4, wherein the ring includes retractable platforms associated with the rollers to enable the rollers to be lowered.

6. The apparatus of claim 4, further comprising a wire supply for supplying currently wound windings at a level of one of the rollers, the wire supply including means for selectively exerting a traction or an axial pressure on the wire.

7. The apparatus of claim 4, wherein the rollers are cone-shaped, and have a greater diameter on an end nearest to the core.

8. The apparatus of claim 4, wherein the rollers are fixed and the ring, shims and core are all rotatable with respect to said rollers.

* * * * *